US007173223B2

(12) United States Patent
Kuo et al.

(10) Patent No.: US 7,173,223 B2
(45) Date of Patent: Feb. 6, 2007

(54) FLEXIBLE ELECTRO-HEATING APPARATUS AND FABRICATION THEREOF

(75) Inventors: Chun-Jung Kuo, Taipei Hsien (TW); Yang Shun-Tung, Taipei Hsien (TW); Lu Fan-De, Taipei Hsien (TW)

(73) Assignee: Tex-Ray Industrial Co., Ltd., Taipei Hsien (TW)

( * ) Notice: Subject to any disclaimer, the term of this patent is extended or adjusted under 35 U.S.C. 154(b) by 91 days.

(21) Appl. No.: 10/940,630

(22) Filed: Sep. 15, 2004

(65) Prior Publication Data

US 2005/0061801 A1 Mar. 24, 2005

(30) Foreign Application Priority Data

Sep. 19, 2003 (TW) ..... 92125919 A

(51) Int. Cl.
*H05B 3/54* (2006.01)

(52) U.S. Cl. ..... 219/529; 219/528; 219/545

(58) Field of Classification Search ..... 219/529, 219/545, 549, 211, 528, 208, 210; 338/208, 338/210

See application file for complete search history.

(56) References Cited

U.S. PATENT DOCUMENTS 4,792,662 A * 12/1988 Kitagaki et al. ..... 219/545
4,983,814 A * 1/1991 Ohgushi et al. ..... 219/545
5,298,722 A * 3/1994 Tanaka ..... 219/545
5,422,462 A * 6/1995 Kishimoto ..... 219/545
5,484,983 A * 1/1996 Roell ..... 219/545
6,150,642 A * 11/2000 Weiss et al. ..... 219/528
6,545,253 B2 * 4/2003 Lin et al. ..... 219/528

* cited by examiner

*Primary Examiner*—Robin Evans
*Assistant Examiner*—Vinod D. Patel
(74) *Attorney, Agent, or Firm*—Troxell Law Office, PLLC

(57) ABSTRACT

The invention provides a flexible electro-heating apparatus and fabrication thereof. The electro-heating apparatus, according to the invention, includes a fabric-type heating device, at least one pair of terminals, and a power supply. The heating device is formed by at least M first yarns which each first yarn substantially consists of first textile fibers and metal fibers or metallic fibers. N first yarns of the M first yarns are woven through the heating device from a first side of the heating device to a second side of the beating device. Each pair of terminals is respectively and oppositely disposed on the first side and the second side of the heating device. When the power supply electrically connects to the terminals disposed on the first side and the second side of the heating device, the power supply is, capable of applying a voltage between the first side and the second side of the heating device such that an electric current resulting from the voltage flows through the N first yarns woven through the beating device from the first side to the second side. The N first yarns then generate heat induced by the electric current.

7 Claims, 3 Drawing Sheets

FLEXIBLE ELECTRO-HEATING APPARATUS AND FABRICATION THEREOF

BACKGROUND OF THE INVENTION

1. Field of the Invention

The present invention relates to a flexible electro-heating apparatus and fabrication method thereof. Moreover, in particular, the electro-heating apparatus according to the invention includes a fabric-type heating device. In daily life, the electro-heating apparatus of the invention can be implemented as various articles providing heat, such as garments for keeping warm, electric blankets, window curtains for isolating cold air, cushions for melting snow, repair kits for repairing tires, etc.

2. Description of the Prior Art

With the development of material science and engineering, various kinds of fabrics with heating function are developed. The prior arts of these fabrics are described as follows.

The first type of fabrics with heating function uses heating devices that are mainly formed of traditional heating coils or heating flakes, combining with typical fabrics. It is necessary to stress that the characteristics of the first type of fabrics with heating function are merely to use textile fabric to wrap up traditional heating-coils or heating flakes. The related prior arts of the above-mentioned type are listed as follows: U.S. Pat. Nos. 6,160,246; 6,111,233; 5,792,714; and Taiwan Utility Model Patent Nos. 135,293; 282,662; and 117,353.

The first type of fabrics with beating function have many problems mainly caused by adopting heavy heating coils or beating flakes, e.g., limited heating efficiency, limited applications, lack of safety measures.

The second type of fabric with heating function uses endothermic/exothermic particles of phase change materials that are coated on the textile fabric, and thus the type of fabric is able to adjust temperature by the endothermic/exothermic property of the phase change materials. The related prior arts of the second type of fabrics with heating function are listed as follows: the U.S. Pat. Nos. 5,885,475 and 6,207,738. Comparing with the first type of fabric with heating function, the second type of fabric with heating function can be made into flexible fabric with beating function.

However, the endothermic/exothermic property of the phase change material used by the second type of fabric with heating function, is limited The adjustable temperature range of the second type of fabric with heating function is very narrow, and about ±2° C. Besides, wearers are unable to control the temperature provided by the second type of fabric with heating function. Therefore, the real efficiency of the textile fabric, coated with particles of phase change materials all over, is merely for keeping wearer comfortable, but not for keeping wearer warm. Besides, the cost of the second type of textile fabric with phase change material is expensive. Even though the second type of fabric with heating function is washable, its washing frequency is limited owing to limitation of used phase change materials.

To form the third type of fabric with heating function, first, metal fibers are twirled into conductive yarns, and then the conductive yarns directly combine with a soft matrix (ex. weave cloth) as the third type of fabric by textile technology. The conductive yarns also make conductive circuits of the fabric with heating function to replace heating coils used in traditional heating apparatus. The above-mentioned conductive yarns, which combine with the soft matrix and make conductive circuits, must be connected to a power supply, and transfer electric energy supplied by the power supply into heat. Obviously, the third type of fabric with heating function can be made into flexible electro-heating apparatus. The third type of fabric with heating function can further combine with, a temperature sensor and a temperature controller to provide users with the function of controlling temperature. The related prior arts of the fabrics with heating function using heaters made of conductive yarns are listed as follows: the U.S. Pat. No. 6,548,789 and the U.S. Pat. No. 6,545,253.

The third type of fabric with heating function overcomes those drawbacks of traditional electro-heating apparatuses, such as heaviness of metal coils, inconvenience to wash, etc. Therefore, the third type of fabric with heating function can be extensively put into practice for keeping warm or for isolating cold air, e.g., garments for keeping warm, electric blankets, hot compress cushions, seat cushion for keeping warm, and window curtains for isolating cold air, etc.

However, the third type of fabric with heating function still has an obvious drawback, that is, only the areas of the fabric covered by conductive yarns can provide heat because the heat is transferred from electric energy by circuit loop formed of the conductive yarns. More exactly, this type of fabric is a one-dimensional electro-heating apparatus, meaning that the zone covered by heat source is substantially a one-dimensional, zone. Therefore, the temperature distribution generated by this type of heating fabric is not uniform. Besides, even, though the application of the third type of fabric with heating function is extensive, this type of fabric cannot be used under the environment in which higher heating power is needed for unit areas, such as the environment in which over 1000 W/m$^2$ heating power is needed for unit areas.

SUMMARY OF THE INVENTION

Therefore, one objective of the present invention is to provide a flexible electro-heating apparatus. And more particularly, the zone covered by heat source resulting from the flexible electro-heating apparatus is substantially a two-dimensional zone, i.e., the heat in the zone covered by heat source distributes uniformly.

The other objective of the present invention is to provide a flexible electro-heating apparatus. And more particularly, the application range of the flexible electro-heating apparatus is extensive, and the flexible electro-heating apparatus can be applied not only under the environment in which lower heating power is needed for unit areas, but also under the environment in which higher heating power is needed for unit areas.

According to the present invention, the flexible electro-heating apparatus comprises a fabric-type heating device, at least one pair of terminals, and a power supply. The heating device has a first side and a second side opposite to the first side. The heating device is formed by at least M pieces of first yarn, each of which substantially consists of first textile fibers and metal fibers or metallic fibers. N pieces out of the M pieces of first yarn are woven through the heating device from the first side to the second side, wherein M and N are natural numbers respectively, and N is less than or equal to M. Each pair of terminals is respectively and oppositely disposed on the first side and the second side of the heating device. One of the two electrodes of the power supply is detachably and electrically connected to the terminals disposed on the first side of the beating device. Another of the two electrodes of the power supply is detachably and electrically connected to the terminals disposed on the second side of the heating device. When the power supply electrically connects to the terminals disposed on the first and the second side of the beating device, the power supply is capable of applying a voltage between the first side and second side of heating device; therefore, an electric current resulting from the voltage flows through the N pieces of first yarn woven through the heating device from the first side to the second side, and the N pieces of first yarn then generate a heat induced by the electric current.

The advantage and spirit of the invention may be understood by the following recitations together with the appended drawings.

BRIEF DESCRIPTION OF THE APPENDED DRAWINGS

DETAILED DESCRIPTION OF THE INVENTION

The embodiments and the practical applications of the present invention will be described in the following paragraphs, so as to sufficiently explain the characteristics, spirits, and advantages of the invention.

Figure 1A:
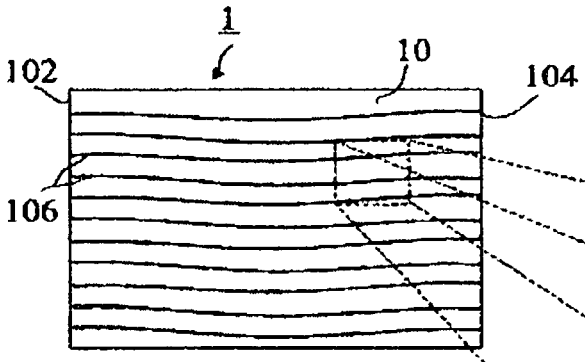
FIG. 1A is a schematic diagram of a fabric-type heating device that is one of the essential devices of the flexible electro-heating apparatus according to the present invention.

Referring to FIG. 1A, FIG. 1A is a schematic diagram of a heating device 10 that is one of the essential devices of the flexible electro-heating apparatus 1 according to the present invention. More particularly, the heating device 10 is a fabric-type heating device. As shown in FIG. 1A, the heating device 10 has a first side 102 and a second side 104, opposite to the first side 102. The heating device 10 is formed of at least M first yarns that each fiber substantially consists of first textile fibers and metal fibers or metallic fibers.

In one embodiment, the first textile fibers, blending, spinning or twisting win, the metal fibers into the first yarn, can be common natural fibers or synthetic fibers, such as cotton fibers, PET fibers, Aramid fibers, etc. The selection of materials of the first textile fibers eventually depends on the environment under which the flexible electro-heating apparatus 1 is applied.

In one embodiment, when the first yarns consist of the first textile fibers and the metal, fibers, the metal, fibers can be metal filaments, long metal fibers or short metal fibers. Equivalent diameter of signal metal fiber is in a range of 1 μm to 50 μm. The materials of the metal fibers prefer to not only be high corrosion-resistant, but also with a proper impedance value for practical applied environment. In practical applications, the best materials of the metal fibers are Ni—Cr alloy fibers or stainless steel fibers. When the first yarns consist of the first textile fibers and the metallic fibers, the metallic fibers can be natural fibers, synthetic fibers, carbon fibers, or glass fibers coated with copper, aluminum or silver.

In practical applications, the percentage of the metal fibers or metallic fibers in the first yarn depends on the impendence needed by the heating device 10. The reasonable volume percentage range of the metal fibers or metallic fibers in the first yarns is from 1% to 100%.

It is noted that N first yarns of the M first yarns are woven through the heating device 10 from the first side 102 to the second side 104 by a, textile process, wherein M and N are natural numbers respectively, and N is less than or equal to M.

Further, the heating device 10 also includes a plurality of second yarns. The second yarns are interwoven with the M first yarn to form the heating device 10. In one embodiment, each of the second yarns also contains 1 to 100 volume percent of metal fibers or metallic fibers.

For the convenience of description, FIG. 1A only shows some first yarns in the N of first yarn 106 woven through the heating device 10, and the others of the first yarns and other kinds of yarns, interwoven with the first yarns to form the beating device 10, are not shown in FIG. 1A. It should be noticed that the way of weaving the first yarns 106 is not clearly drawn in FIG. 1A. The way of interweaving the first yarns, woven through the heating device 10, with the other yarns will be thoroughly described in the following paragraphs.

Figure 1B:
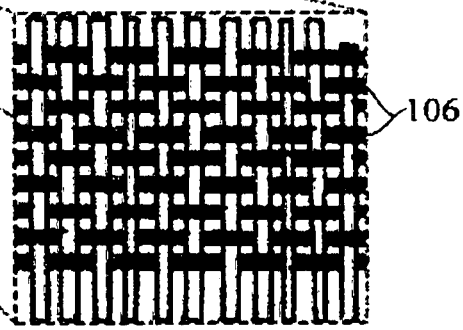
FIG. 1B is a sectional magnified diagram of the fabric-type heating device in shown FIG. 1A to show that the beating device is formed by the weaving process.

In one embodiment, the textile process is a weaving process. Referring to FIG. 1B, the sectional magnified diagram of the heating device 10 shows the practical interweaving situation between the two first yarns 106, shown in FIG. 1A, and the other yarns when the heating device 10 is formed by the weaving process. In this case shown in FIG. 1B, no other yarns are introduced between two adjacent first yarns 106. In practical application, the interval between two adjacent first yarns 106, i.e., the number of other yarns introduced two adjacent first yarns, depends on the impendence needed by the heating device 10.

Figure 1C:
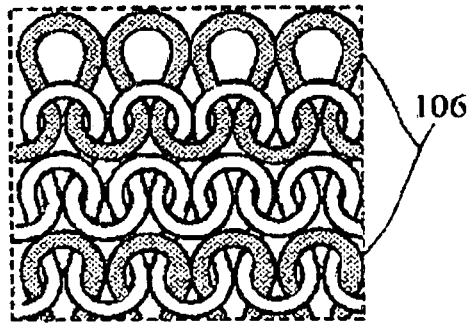
FIG. 1C is a sectional magnified diagram of the fabric-type heating device shown in FIG. 1A to show that the beating device is formed by the knitting process.

In another embodiment, the textile process is a knitting process. Referring to FIG. 1C, the sectional magnified diagram, of the heating device 10 shows the practical interweaving situation between the two of first yarns 106, shown in FIG. 1A, and the other yarns when the heating device 10 is formed by the knitting process. In another embodiment, the textile process is a sewing process.

Figure 2:
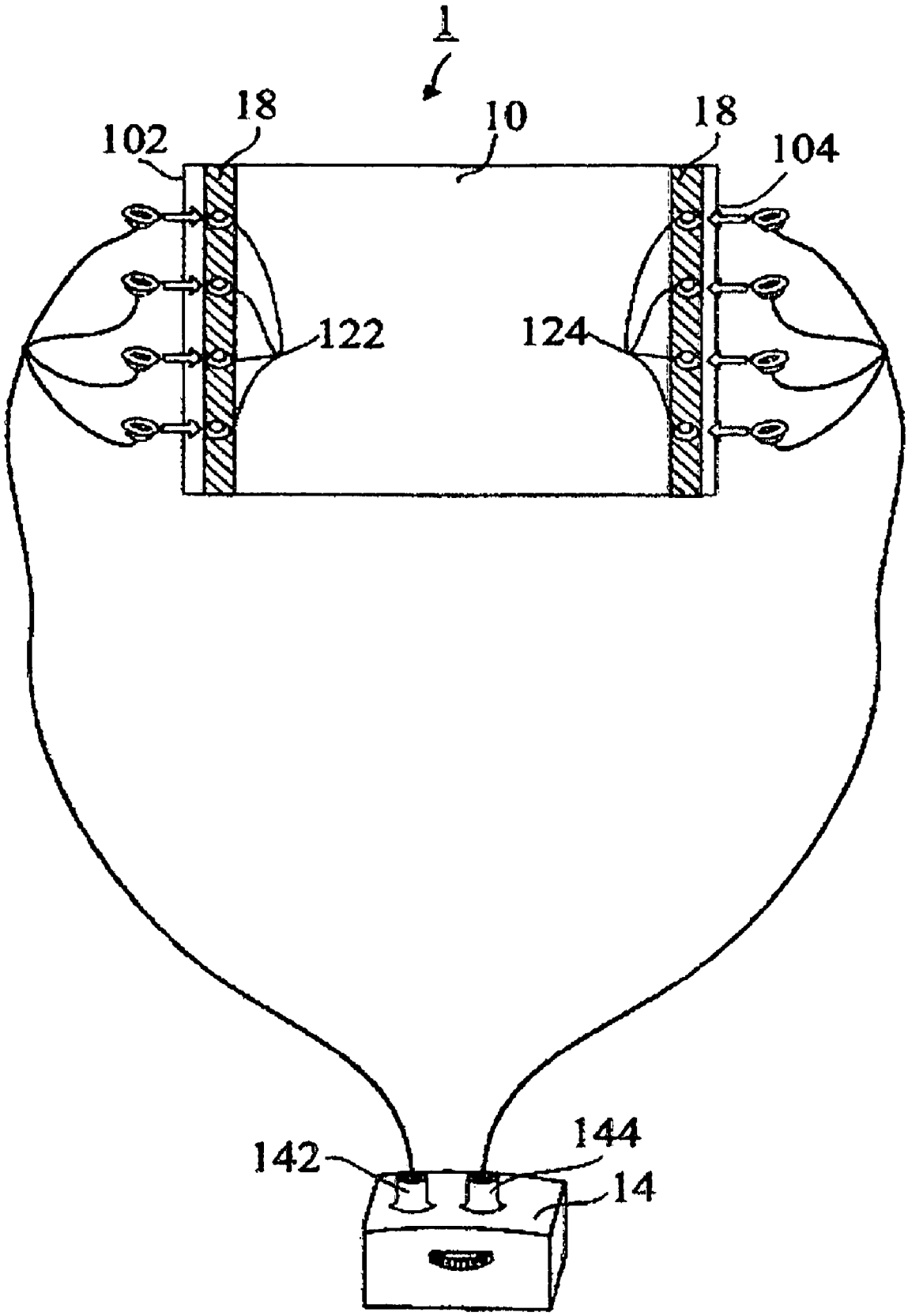
FIG. 2 is a schematic diagram of the flexible electro-heating apparatus according to one embodiment of the present invention.

As to the other essential devices of the flexible electro-heating apparatus 1 of the present invention, please refer to FIG. 2. The devices with the same symbols in FIG. 2 and FIG. 1A are mentioned in previous paragraphs and will not be described in the following paragraphs.

As shown in FIG. 2, the flexible electro-heating apparatus I also includes at least one pair of terminals. More particularly, each pair of terminals is respectively and oppositely disposed on the first side 102 and the second side 104 of the heating device 10. To decide the number of disposed terminals, one must consider whether the distribution of the electric current, resulting from the voltage of the heating device 10 when applying the outer power source, is uniform. In some applications, such as garments for keeping warm, the terminals can utilize devices that have smaller contact areas but easily washable, like the metal connectors. In some applications, such as repair kits, the terminals can utilize the devices that have larger contact areas, like the alligator clips with larger contact areas.

For the convenience of descriptions, only four pairs of metal connectors (terminals) are shown in FIG. 2. For example, as shown in FIG. 2, four metal connectors 122 are disposed on the first side 102 of the heating device 10, and the other four metal connectors 124 are disposed on the second side 104.

As shown in FIG. 2, the flexible electro-heating apparatus 1 also includes a power supply 14. It should be noticed that the first side 102 and the second side 104 of the heating device 10 do not have polarity. One of the two electrodes of the power supply 14 is detachably and electrically connected to the terminals disposed on the first side 102 or the second side 104 of the heating device 10, and another of the two electrodes of the power supply 14 is detachably and electrically connected to the terminals disposed on the other side of the heating device 10 which has not been connected yet. As shown in FIG. 2, the two electrodes of the power supply 14 are marked as 142 and 144. When one electrode 142 of the power supply 14 is connected to the four metal connectors 122, the other electrode 144 of the power supply 14 is connected to the four metal connectors 124.

Also shown in FIG. 2, to increase uniformity of the electric current distributed, metal wires, such as copper wires, can be woven through the heating device 10 to form conductive zones 18 on the heating device 10 before disposing the connectors (122 and 124). Obviously, the conductive zones 18 cover the connectors (122 or 124) disposed, and the disposed connectors (122 or 124) would be electrically connected from one another by the conductive zones 18.

When the power supply 14 electrically connects to the metal connectors/terminals (122 and 124), the power supply 14 is capable of applying a voltage between the first side 102 and second side 104 of the heating device 10, this is done in a way that an electric current resulting from the voltage flows through the N first yarns (not shown) woven through the heating device 10 from the first side 102 to the second side 104. The N first yarns then generate a heat induced by the electric current. Obviously, according to the flexible electro-heating apparatus of the present invention, the zone covered by heat source is substantially a two-dimensional zone, i.e., the heat in the zone covered by heat source distributes uniformly.

Other than metal connectors, the at least one pair of terminal of the flexile electro-heating apparatus 1 can be embodied by two metal, wires such as two copper wires (not illustrated). In such case, one of the metal wires as terminals can be sewed through or soldered on the first side 102 of the heating device 10, and the other of the metal wires can be sewed through or solder on the second side 104 of the heating device 10. Two ends of each metal wire can be exposed for providing with connection for the two electrodes of the power supply 14. Alternatively, metal buttons can be mounted onto one or two ends of each metal wire for providing with connection for the two electrodes of the power supply 14.

The following paragraphs are the detailed description of the fabrication procedures of the flexible electro-heating apparatus according to the present invention. First, by use of at least M first yarns, a fabric-type heating device is woven via a textile process. During fabrication, a first side and a second side, opposite to the first side, of the heating device must be defined. Each of the first yarns substantially consists of first textile fibers and, metal fibers or metallic fibers. N first yarns of the M first yarns are woven through the heating device from the first side to the second side, wherein M and N are natural numbers respectively, and N is less than or equal to M.

Next, by use of at least one pair of terminals, each pair of terminals is disposed respectively and oppositely on the first side and the second side of the heating device.

Then, a power supply is provided. One of the two electrodes of the power supply is detachably and electrically connected to the terminals disposed on the first side of the heating device, and the other of the two electrodes of the power supply is detachably and electrically connected to the terminals disposed on the second side of the heating device.

When the power supply electrically connects to the terminals, the power supply is capable of applying a voltage between the first side and second side of heating device such that all electric current resulting from the voltage flows through the N first yarns woven through the heating device from the first side to the second side, and the N first yarns then generate a heat induced by the electric current.

It should be noticed that the flexible electro-heating apparatus 1, shown in FIG. 2 is not the complete form of the flexible electro-heating apparatus for daily use. The complete form of the flexible electro-heating apparatus of the invention for daily use and its application range will be described in the following paragraphs.

In one practical application, the flexible electro-heating apparatus can be formed as a garment for keeping warm. For a sample form of garments for keeping warn, please refer to FIG. 3. The devices with the same symbols in FIG. 3 and FIG. 2 are the devices mentioned in previous paragraphs and will not be described in the following paragraphs.

Figure 3:
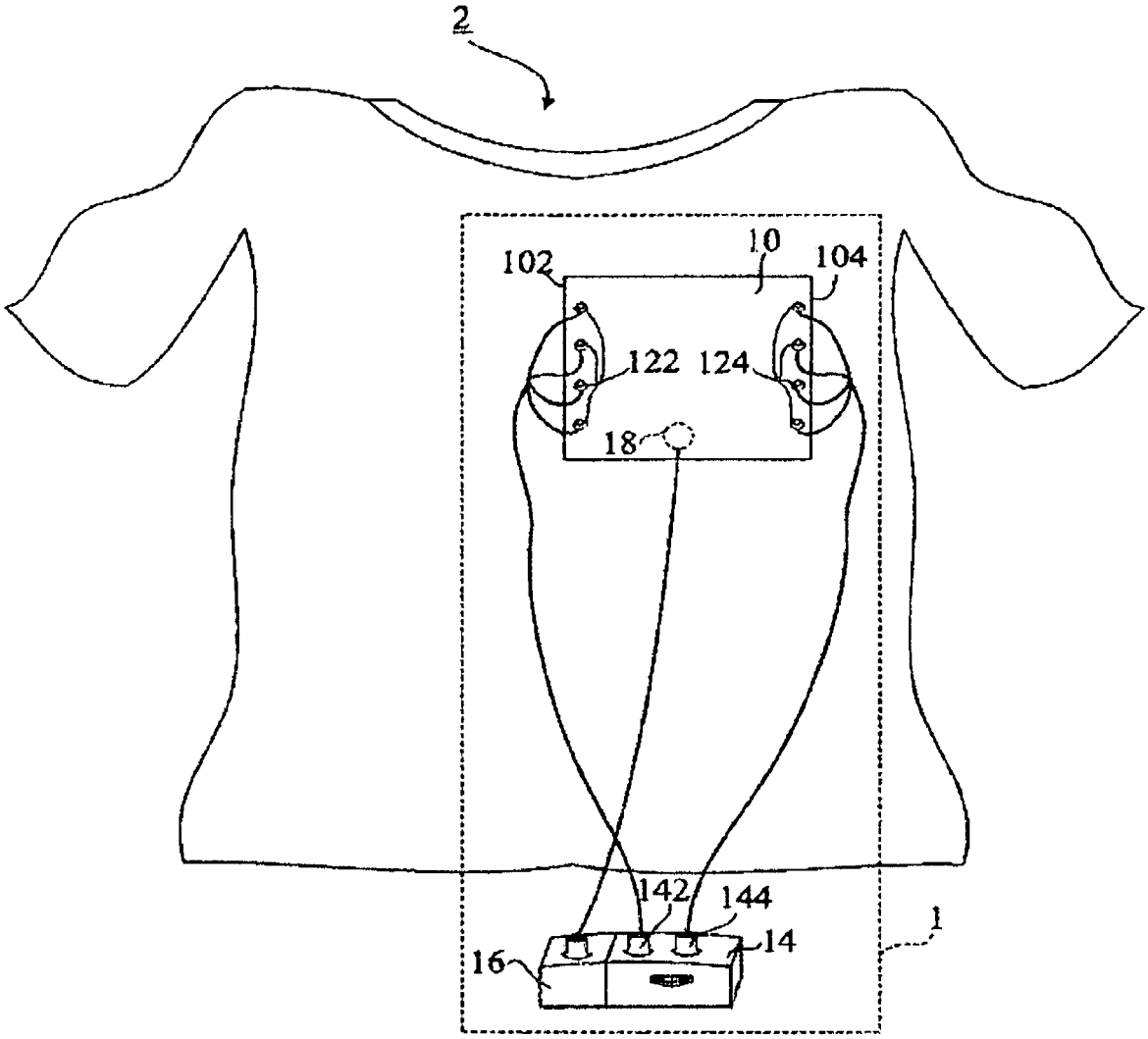
FIG. 3 is a schematic diagram of a garment for keeping warm by using the flexible electro-heating apparatus of the invention.

As shown in FIG. 3, the above-mentioned heating device 10 of the flexible electro-heating apparatus 1 of the invention is sewn onto a garment 2. The disposed location of the heating device 10 is specified, according to the positions of human bodies that need to be kept warm. As shown in FIG. 3, the disposed location of the heating device 10 on the garment 2 is designed to keep the heart of the human body warm.

The flexible electro-heating apparatus 1 shown in FIG. 3 further includes a temperature controller 16 and a temperature sensor 18. The temperature controller 16 is used for controlling the power supply 14 and further controlling the electric current flow in the N first yarns that are woven through the heating device 10. The temperature sensor 18 can be set on the temperature controller 16 or at the location that needs to measure the temperature and electrically connect to the temperature controller 16 (as shown in FIG. 1). The temperature sensor 18 is used for measuring the temperature and transmitting the measured temperature data to the temperature controller 16. The temperature controller 16 controls the power supply 14 in accordance with temperature in measured by the temperature sensor 18.

In FIG. 3, the power supply 14 and the temperature controller 16 are formed as an integral type of controller, that is the general method for lowering the entire fabrication, costs, and this type of controller can be attached to the waist by a belt. Naturally, according to the present invention, the power supply 14 and the temperature controller 16 can be formed as individual sub-devices in accordance to practical demands.

In one embodiment, the temperature controller 16 includes a microprocessor. The flexible electro-heating apparatus 1 measures the surrounding temperature by the temperature sensor 18, and then the microprocessor of the temperature controller 16 automatically adjusts the temperature to the temperature set in the beginning. In another embodiment, the temperature controller 16 is a manual temperature controller, and thereby users can adjust the output power of the power supply at their will so as to reach the goal of keeping warm.

The temperature sensor 18 is disposed at a suitable location (shown in FIG. 3) on the garment 2 for suiting the design of garments for keeping warm. The temperature sensor 18 detachably connects to the temperature controller 16 by a conducting wire. Under this design, the temperature sensor 18 must be a waterproof device or be processed under a waterproof condition. The temperature sensor 18 measures the temperature of the microclimate between the human body and the garment 2. The microclimate is the actual controlled environment of textile products for bringing the temperature and comfort sensed by human bodies. Therefore, by suitably controlling the microclimate, it not only sufficiently fulfills the function of keeping warm but also saves the energy needed for heating.

Besides garments, the flexible electro-heating apparatus also can be sewn on other kinds of textile products, such as gloves, hats, or socks, etc. The heating device 10 can be sewn on different locations of textile products according to customers' demands, such as the belly, the back, or the heart, etc., so as to reach the goal of keeping warm yet being light, thin, and easy to carry. Therefore, by producing the flexible electro-heating apparatus as a wearable electro-heating apparatus (ex. garments for keeping warm), the disadvantage of being heavy and un-washable of the prior arts, which use heating coils to be the beating devices, can be solved. Furthermore, because the compositions comprise metal yarn of metal fibers, the present invention also has the ability to resist static electricity and electromagnetic wave.

Besides the wearable electro-heating apparatus such as the garments for keeping warm, the flexible electro-heating apparatus of the present invention can also be formed as an electro-heating blanket, a cushion for keeping warm, a window curtain for isolating cold air, a cushion for melting snow, a cushion for warming feet, or a repair kit for repairing tires. Obviously, according to the heating apparatus of the present invention, the application range is far more extensive than those of the prior arts that adopt heavy heating coils as the heating apparatus. More emphatically, according to the beating apparatus of the present invention, it is very easy to reach the goal of being light, thin, and easy to carry. Moreover, it is simple and convenient to use yet not likely to cause danger. In the next paragraph, the application environment and the executing conditions of several applications will be listed, so as to prove that the application range of the flexible electro-heating apparatus of the invention is extensive.

Referring to table 1, table 1 lists the related data of the materials of the heating device, the power supply, the temperature range, and the power in practical applications of the garment for keeping warm, the electro-heating blanket, and the self-heating repair kit formed by the flexible electro-heating apparatus of the present invention. Each practical application will be described in the following paragraphs.

TABLE 1

| Practical Application | Garment for keeping warm | Electro-heating blanket | Self-heating repair kit |
|---|---|---|---|
| Materials of heating device | 10% Vol. 4~14 μm S.S. fibers + PET fibers or cotton fibers | 20% Vol. 4~14 μm S.S. fibers + PET fibers or cotton fibers | 10% Vol. 4~14 μm S.S. fibers + Aramid fibers |
| Power supply | D.C. 12 Volt. | D.C. 24 Volt. | A.C. 110 Volt. or 220 Volt. |
| Temperature range | 33~45° C. | 40~70° C. | 120~180° C. |
| Power | 120~480 W/m$^2$ | 400~1200 W/m$^2$ | 3000~4800 W/m$^2$ |

As to the practical applications of the garment for keeping warm in table 1, the garment uses 10% Vol. 4~14 μm stainless steel fibers (S.S. fibers) and PET fibers to weave onto the fabric-type beating device, and it adopts the 12V DC power. After being practically tested, the heating power provided by the above-mentioned garment is about 120~480 W/m$^2$. In the above-mentioned power range, the surface temperature of the heating device of the garment is measured by the IR- thermograph, and the surface temperature of the heating device ranges from 33 to 45° C. In practical application, there is an insulating layer between the heating device and the human body. Obviously, the practical application of the above-mentioned garment can provide the function of keeping the use warm.

As to the practical applications of the electro-heating blanket in table 1, the electro-heating blanket uses 20% Vol. 4~14 μm S.S. fibers and PET fibers (or cotton fibers) to weave onto the fabric-type heating device, and it adopts the 24V DC power for safety. In practical tests, the heating power provided by the above-mentioned electro-heating blanket is about 400~1200 W/m$^2$. In the above-mentioned power range, the surface temperature of the heating device of the electro-heating blanket is measured by the IR-thermograph, and the surface temperature of the heating device ranges from 40 to 70° C. In practical application, there is an insulating layer between the heating device and the human body. Obviously, the above-mentioned electro-heating blanket of the practical application can provide the function of keeping the user warm.

Before explaining the practical applications of the self-heating repair kit in table 1, it is necessary to explain about the traditional repair kits and the procedures taken when repairing tires by traditional repair kits. Traditional repair kits are formed by a kind of composite material that combines thermoplastic macromolecule material and reinforced material. As to the procedures of repairing tires by use of traditional repair kits, first, the repair kit is placed on the hole of the tire, then the heating device formed by the traditional heated flake is placed against the traditional repair kit, further providing heat to the traditional repair kit. In the meantime, extra pressure must be applied on the heated flake leaned against the repair kit, so as to deliver pressure to the repair kit. Therefore, by applying pressure and gradually melting the repair kit, it is combined with the tire on the hole.

As to the above-mentioned traditional heating flakes for repairing tires, the property of the material itself is hard and brittle and is bended after repairing tires. The bended heating flakes will easily break if it is hit by external forces. Besides, the traditional repair equipments for repairing tires are too heavy, and are disadvantageous to be the on-the-spot repair equipments.

To form the flexible electro-heating apparatus of the present invention, from the self-heating repair kit, the fabric-type heating device of the flexible electro-heating apparatus is dipped in a covering component consisted of thermoplastic macromolecule materials for covering the upper and lower surface. Then, the heating device covered with the thermoplastic macromolecule materials is being dried. Finally, the fabric-type heating device, covered with the thermoplastic macromolecule materials, is produced, forming the self-heating repair kit. After connecting with the power supply, the repair kit formed from the fabric-type can generate heat by applying voltages; therefore, the repair kit of this type is so-called the self-heating repair kit.

As to the practical application of the self-heating repair kit in table 1, the self-heating repair kit uses 10% Vol. 4~14 μm S.S. fibers and Aramid fibers to weave into the fabric-type heating device and adopts the 110V or 220V AC power. After conducting practical tests, the heating power that can be provided by the above-mentioned self-heating repair kit is about 3000~4800 $W/m^2$ In the above-mentioned power range, the surface temperature of the repair kit is measured by the IR-thermograph, and the surface temperature of the repair kit ranges from 120 to 180° C. Obviously, the above-mentioned self-heating repair kit not only avoids the problem, of using the traditional heating flakes, but also combines the power supply for the convenience of being on-the-spot repair equipments.

It must be emphasized that the heating devices according to the invention for various applications can all be made by a typical textile process. Obviously, the invention also provides a low cost solution for flexible electro-heating apparatus.

With the example and explanations above, the features and spirits of the invention will be hopefully well described, Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A method of fabricating a flexible electro-heating apparatus, comprising the steps of:

by using at least M first yarns, weaving a fabric-type heating device via a textile process, wherein the heating device has a first side and a second side opposite to the first side, each of the first yarns substantially consists of first textile fibers and metal fibers or one of metallic fibers, N first yarns of the M first yarns are woven through the heating device from the first side to the second side, M and N are natural numbers respectively, and N is less than or equal to M;

by using at least one pair of terminals, disposing each pair of terminals respectively and oppositely on the first side and the second side of the heating device;

providing a power supply, one of two electrodes of the power supply being detachably and electrically connected to the terminals disposed on the first side of the heating device, another of two electrodes of the power supply being detachably and electrically connected to the terminals disposed on the second side of the heating device; and wherein when the power supply electrically connects to the terminals disposed on the first side and the second side of the heating device, the power supply is capable of applying a voltage between the first side and second side of heating device such that an electric current resulting from the voltage flows through the N first yarns woven through the heating device from the first side to the second side, the N first yarns then generate a heat induced by the electric current wherein the fabric-type heating device is configured for forming a garment and wherein the textile process is one selected from the group consisting of a weaving process, a knitting process and a sewing process.

2. The method of claim 1, wherein each of the first yarns contains the metal fibers or the metallic fibers in an amount between 1 to 100 volume percentage.

3. The method of claim 2, wherein when the first yarns consist of the first textile fibers and the metal fibers, the metal fibers are Ni—Cr alloy fibers or stainless steel fibers, and when the first yarns consist of the first textile fibers and the metallic fibers, the metallic fibers are natural fibers, synthetic fibers, carbon fibers, or glass fibers coated with copper, aluminum or silver.

4. The method of claim 3, wherein the heating device also comprises a plurality of second fibers, the second yarns are interwoven with the first yarns to form the heating device.

5. The method of claim 4, wherein each of the second yarns contains second textile fibers.

6. The method of claim 5, wherein each of the second yarns also contains the metal fibers or the metallic fibers of 1 to 100 volume percentage.

7. The method of claim 1, wherein the fabric-type heating device is substantially elastic.

* * * * *